United States Patent [19]

McIntyre

[11] 4,144,606

[45] Mar. 20, 1979

[54] DIVER'S SPAR BUOY AND FLAG

[76] Inventor: Robert T. McIntyre, 10706 Orchard St., Fairfax, Va. 22030

[21] Appl. No.: 783,497

[22] Filed: Mar. 31, 1977

[51] Int. Cl.[2] ..... B63C 9/00

[52] U.S. Cl. ..... 9/8 R

[58] Field of Search ..... 9/8 R, 9, 8.3 R; 116/173, 174, 175, 124 B

[56] References Cited

U.S. PATENT DOCUMENTS

| | | | |
|---|---|---|---|
| 2,947,557 | 8/1960 | Schwab et al. | 116/173 |
| 3,167,793 | 2/1965 | Keats | 9/8 R |
| 3,605,147 | 9/1971 | Shelton | 9/8 R |
| 3,760,441 | 9/1973 | Handelman | 9/8 R |

FOREIGN PATENT DOCUMENTS

| | | | |
|---|---|---|---|
| 486679 | 11/1929 | Fed. Rep. of Germany | 116/173 |

*Primary Examiner*—Trygve M. Blix
*Assistant Examiner*—Jesus D. Sotelo
*Attorney, Agent, or Firm*—Strauch, Nolan, Neale, Nies & Kurz

[57] ABSTRACT

A collapsible spar buoy made of separable sections having a flag and requiring no conventional, additional float device. A central section and a base member entrap air to serve as a float. This central section houses all the other components when the buoy and flag are stored. The flag may be conventionally mounted or centrally mounted so that its mass is centered with respect to the mass of the buoy; thus the buoy and flag assume a vertical attitude in the water.

8 Claims, 4 Drawing Figures

DIVER'S SPAR BUOY AND FLAG

BACKGROUND OF THE INVENTION

This invention relates to scuba diving, primarily for sport or recreational purposes, and more particularly to an indicator in the form of a spar buoy and flag to warn surface vessels that a diver is in the vicinity, under water. Accordingly, the warning is that any surface vessels should stay clear of a substantial area about the flag.

In recreational diving in this country, a flag known as the "diver's down" flag is flown either from an anchored boat, from which divers may be diving, and/or from a surface float which is towed by the diver by means of a line attached to the float. Alternatively, the line from the float may be anchored to the bottom. The "diver's down" flag is a rectangle or square field of red having a white stripe extending diagonally downward from the top of the mast to the lower, outer corner of the flag.

Conventionally, "diver's down" flags for sport diving are sold together with an elongate mast having a styrofoam float about the mid-portion of the mast and a small lead weight at the lower, submerged end of the mast. Such devices have two major disadvantages. First, the mast is so long or tall that the device cannot be easily stored with the diver's other gear as he travels to and from the diving site. For example, many sport divers pack their diving gear in a bag similar to a duffel bag. The diver's flag mast is far too long to fit within such a bag. A second objection to this type of diver's flag device is that the float is made of fragile material (e.g., styrofoam) that soon becomes crushed or broken during transport.

The prior art discloses several forms of flag masts or posts which are collapsible for storage purposes. For example, U.S. Pat. No. 2,499,874 issued to J. W. Peterson and U.S. Pat. No. 3,011,810 issued to M. H. Crowder disclose a folding flag with a tubular staff to contain the flag and a telescoping flag post of adjustable length, respectively. A collapsible spar buoy employing an above discussed objectionable float of some type are illustrated in U.S. Pat. Nos. 3,167,793 issued to J. B. Keats and 3,760,441 issued to P. Handelman. A sonobuoy lacking a conventional float but having a rather sophisticated entrapped air float section means is disclosed in U.S. Pat. No. 3,328,750 issued to G. A. Gimber et al. Centrally mounted flag or display devices are shown in U.S. Pat. No. 3,800,347 issued to B. J. Zuurbier and 3,969,837 issued to S. Kresse.

As for flag display devices specifically designed and intended for submerged divers, the U.S. Patent to J. S. Christiansen, U.S. Pat. No. 3,149,352, discloses an inflatable buoy with an inflated flag stiffener. The device is easily stored when deflated but should the mast be punctured or accidentally deflated, when in use, a not unlikely occurrence, the utility of the device could be lost. In addition, the nuisance of required inflation and deflation of the device each time it is used makes this inflated flag assembly less desirable to the consumer.

Another diver's flag device with an extensible telescoping mast on a float which is designed to be carried by the diver under water and deployed before surfacing is shown in U.S. Pat. No. 3,105,459 issued to S. M. Conn. Again, an objectionable feature of the device is the required fragile float, made of cork, cellular plastic, etc.

The present invention overcomes these several problems by providing a sturdy diver's flag mast structure in the form of a spar buoy of separable components which may be reduced to a single container that can be easily stored and transported with the diver's other gear. In one embodiment, the flag is conventionally mounted on a flag post portion of the spar buoy to vane in the wind; in another embodiment, the flag is mounted centrally on the post to stay in an upright attitude.

SUMMARY OF THE INVENTION

It is the principal object of the invention to provide a diver's spar buoy and flag that requires no conventional float means, is very sturdy in use, and may be stored in a very compact configuration.

It is an object of the invention to provide a diver's spar buoy and flag made of separable components, all interfittable within one another to facilitate easy storage when not in use.

It is another object of the invention to provide a diver's spar buoy and flag that is easily visible when in use.

It is a further object of the invention to provide a diver's spar buoy and flag that is virtually indestructable in use or in transport, yet can be readily fabricated of readily available materials at low cost.

Further novel features and other objects of this invention will become apparent from the following detailed description, discussion and the appended claims taken in conjunction with the accompanying drawings.

DESCRIPTION OF THE PREFERRED EMBODIMENTS

Figure 1:
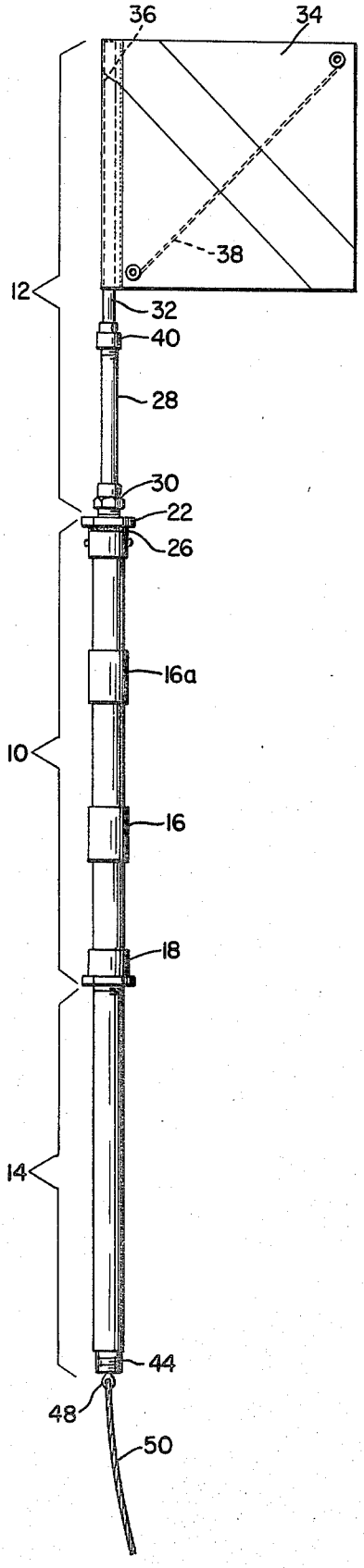
FIG. 1 is an elevation view of a preferred embodiment of the invention, fully assembled and ready for use.

Essentially, the invention is made up of a central storage and floatation section 10, an upper flag post assembly 12, and a lower, submerged base member 14. Central section 10 is an elongate tube of suitable plastics material, such as polyvinyl chloride or PVC. In fact, except for the flag, weight and some seals, the invention may be made entirely of commercially available PVC pipe, plugs and fittings.

Strengthening collars 16 may be spaced along section 10 and the respective ends thereof are closed by a lower permanent cap 18, including a recessed, internally threaded head portion 20, for reasons to be explained below, and a removable, upper cap 22 with a recessed, internally threaded socket 24, for reasons which will be set forth below. An annular seal 26 is located about cap 22 to assure a watertight seal at the upper end of section 10; seal 26 may be in the form of conventional O-ring.

Upper flag post assembly 12 includes a base post member 28, having an externally threaded lower end fitting 30 and a flag support 32, upon which is placed a conventional diver's down flag 34 having a post receiving pocket 36 with a closed upper end and the usual stay 38 for keeping the flag fully unfurled when in use.

The upper flag post assembly 12 is very easily put together and mounted on central section 10. Flag support 32 with its unfurled flag 34 has a lower fitting 40 which is friction fit onto the top of base post member 28. Then, fitting 30 is threaded into mating socket 24 of upper cap 22, on central section 10.

The lower submerged base member 14 is sealed at its upper end by a closed end, threaded internal coupling 42 which also serves to attach base member 14 to central section 10 by threaded reception within head portion 20 of cap 18. The lower end of base member 14 has a weight 44 threaded therewithin. Weight 44 may be made of a section of metal pipe and filled with a quantity of lead 46 or other suitable material, from which depends an eye 48 for attachment of a suitable line 50 which, at its other end, is attached either to a suitable anchor or is carried by the diver (not shown).

Figure 2:
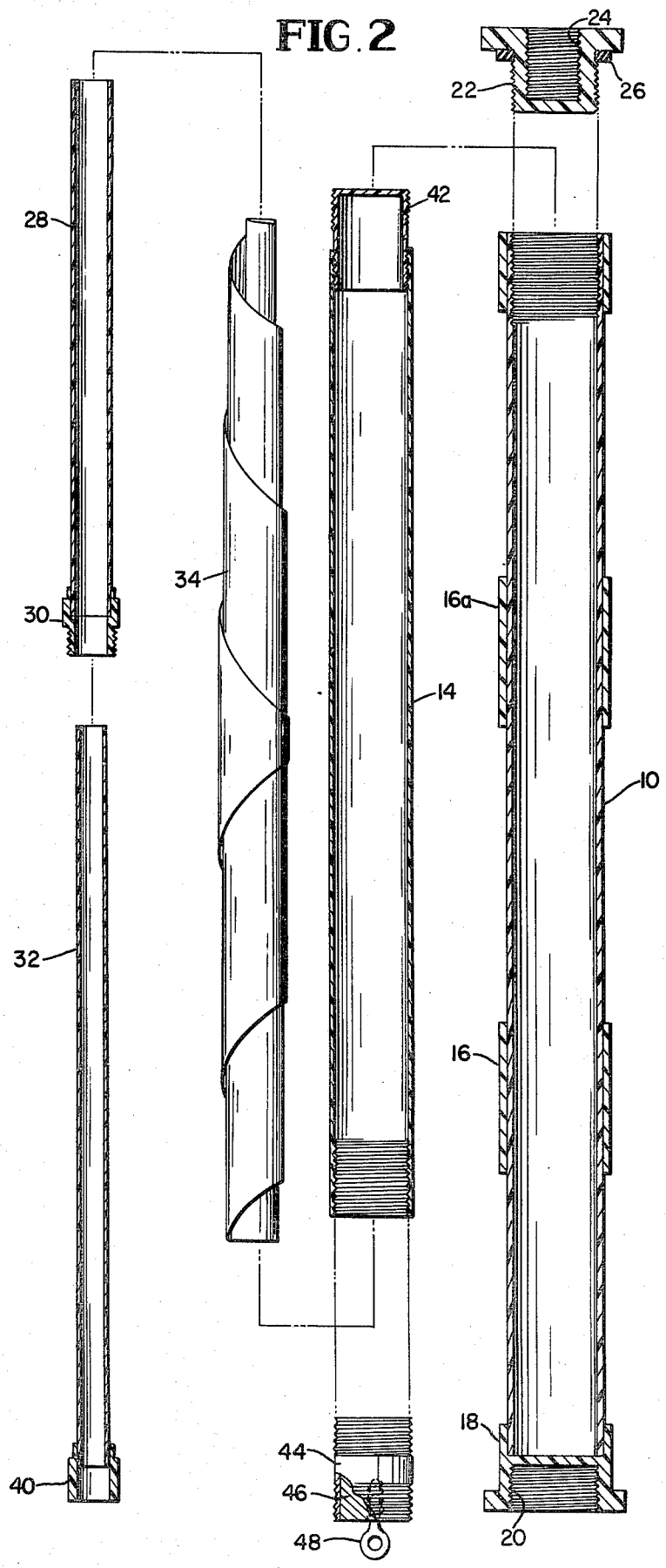
FIG. 2 is an exploded view of the several components of the invention as shown in FIG. 1 but in a storage configuration and drawn to an enlarged scale.

Disassembly and storage of the several components within central section 10 will now be explained. First, flag post assembly 12 is unthreaded from cap 22 and lower base 14 is detached from cap 18. Then flag 34 is removed from post assembly 12 merely by slipping pocket 36 off of flag support 32. Thereafter, the parts 28 and 32 are separated and reversed so that flag support 32 may be inserted within base post member 28 (FIG. 2). Thereafter, flag 34 is furled over the 2 pieces 28, 32, in diagonal fashion so as not to bend stay 38. Then, weight 44 is removed from lower base 14 and the now dismantled upper flag post assembly with flag is inserted into base 14; weight 44 is then threaded back into place to cap base 14.

If cap 22 has not been removed from central storage section 10, then this is done now. Thereafter, base 14 is inserted within section 10 and cap 22 is put back into place.

It is evident that the external diameter of flag support 32 is less than the internal diameter of base 28 and that both are substantially more narrow than submerged base 14 so that the furled up flag and post section may fit easily within base 14. Similarly, base 14 has external diameter and length dimensions less than the internal diameter and length dimensions of central section 10 so as to be easily fitted therein when in storage. Additionally, the overall length of central storage section 10 with caps 22 and 18 is significantly less than that of the conventional diver's gear or duffel bag (not shown) so as to fit easily therewithin for transport.

In the assembled, in use configuration shown in FIG. 1, the waterline will be somewhere between the indicated collar 16 and cap 22. Weight 44 need not be in a sealing relationship with respect to submerged base 14. If water gets into base 14, it will only rise to a level permitted by air trapped within base 14 which is compressed somewhat to surrounding or ambient pressure.

On the other hand, central storage and floatation section 10 is sealed quite adequately by caps 18 and 22 with its seal 26.

Cap 18 and 22 and coupling 42 may be made as one piece components as shown or, alternatively, they may be conventional PVC caps and coupling pieces, filled or closed by a suitable, compatible filler cement or settable compound (not shown).

Assembly of the invention from the storage configuration is accomplished by first removing cap 22 and sliding out base 14. Weight 44 is then removed so that the flag assembly and flag can be taken out. The flag 34 is unfurled and placed onto support 32 which is then fitted onto base post 28. Cap 22 is rethreaded into section 10 whereupon fitting 30 is mounted into cap 22. Assembly is completed by replacing weight 44 onto base 14 and then attaching base 14 to lower cap 18.

Figure 3:
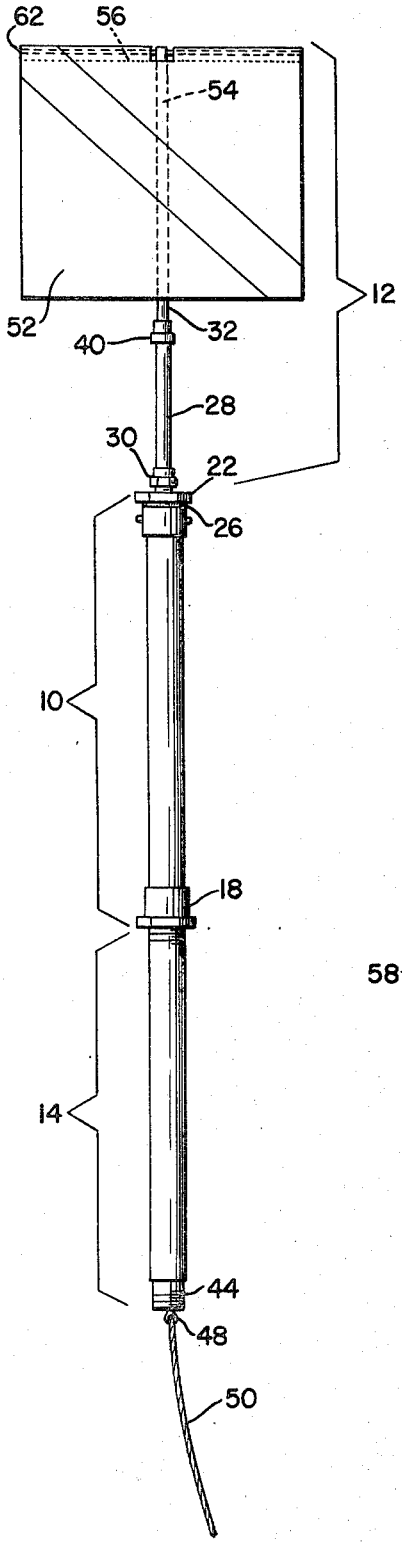
FIGS. 3 and 4 are views similar to FIGS. 1 and 2, respectively, but showing another embodiment of the invention.
Figure 4:
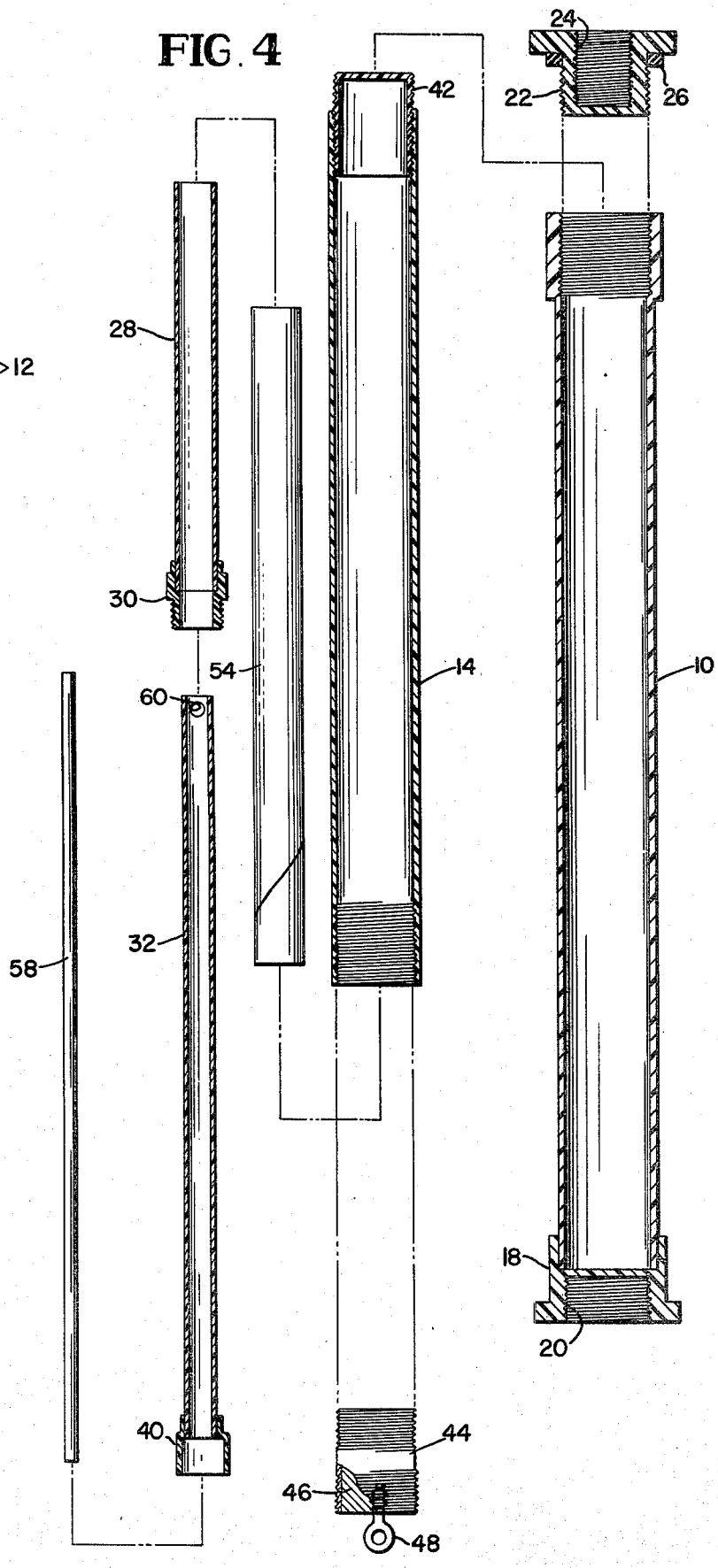

The embodiment shown in FIGS. 3 and 4 is, in most respects, quite similar to that illustrated in FIGS. 1 and 2, except that the flag is centered onto its post and the overall dimensions of the respective components are slightly reduced. However, since essential construction and function of all components except the flag are the same, like reference numerals have been applied to the parts of this embodiment of the invention.

In this embodiment, reinforcing collars 16, **16*a*** are not needed.

More significantly, the diver's down flag 52 is formed with a central vertical pocket 54 for mounting flag 52 onto flag support 32. In addition, a second, hoirzontal open ended stiffening pocket 56 is provided along the top edge of flag 52 for insertion of a stiffening bar or dowel 58 therein and through a bore 60 (FIG. 4) formed through the upper end of flag support 32. Stiffening pocket 56 may be closed at 62 to assure retention of dowel 58 therein.

This construction permits the location of the mass of flag 52 to be centered over the remaining components of the spar buoy so that, in still water at least, the spar buoy and flag stand vertically upright in the water. In the previous embodiment, the structure tends to tilt slightly in the direction of the flag unless the off centered mass of the flag is corrected.

On the other hand, this second embodiment of the invention with the centered flag is somewhat less desired than the principal embodiment, because flag 52 tends to sail in the wind and thus tilt the spar buoy to some degree, dependent on the force of the wind, whereas flag 34 merely vanes into the wind without affecting the attitude of the spar buoy to any appreciable extent, as is the case with conventional flags.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A collapsible spar buoy comprising as separable components: an upper, flag post assembly; a central storage and floatation section; and a lower, submerged, elongate, weighted base member; said upper assembly, central section and base member being relatively dimensioned in length and diameter whereby said upper assembly and said weighted base member fit entirely within said central section when said spar buoy is collapsed to a storage configuration and sealing means on said central section whereby, with said spar buoy in extended assembly, said central section is sealed substantially air tight to thereby function as a float.

2. The spar buoy as claimed in claim 1 wherein said central section sealing means further comprise a sealing cap over the upper end of said central section, said cap having means thereon for mounting said upper post assembly.

3. A spar buoy as claimed in claim 2 wherein said central section sealing means further comprise permanent sealing means fixed in the bottom, lower end thereof, said central section being formed as an elongate tube of plastics material.

4. The spar buoy as claimed in claim 1 wherein said upper, flag post assembly comprises a first, base post member and an upper flag support member, at least said base post being formed as a hollow tube; the inside diameter of said base post being greater than the outside diameter of said upper flag support member, whereby said flag support may be stored within said base post when said spar buoy is in said storage configuration.

5. The spar buoy as claimed in claim 1 further comprising flag means supported on said flag post assembly, said flag means further comprising a first, elongate vertical pocket formed centrally on said flag means into which said flag post is inserted and a second, horizontally formed pocket extending along the upper edge of said flag means, said flag post assembly further comprising a horizontal bar inserted through said flag horizontally formed pocket whereby in use, said flag remains fully extended so that it may be more easily seen and further enables said spar buoy to remain vertically upright due to centering of the mass of said flag and said bar with respect to said spar buoy.

6. The spar buoy as claimed in claim 1 wherein said submerged, weighted base member comprises an elongate tube, means for sealing said base member elongate tube at an end thereof adjacent said central section and weight means attached at the lower end of said base member elongate tube, whereby any water which might enter through said elongate tube lower end will rise only to a level within said base member which is allowed by the amount of air compressed and trapped therewithin.

7. The spar buoy as claimed in claim 1 wherein said upper post assembly, central section and base member are so relatively dimensioned in diameter that said upper post assembly fits entirely within said base member and said base member fits entirely within said central section when said spar buoy is collapsed to said storage configuration.

8. The spar buoy as claimed in claim 1, further comprising fag means, said upper post assembly, central section and base member being so relatively dimensioned in diameter that said upper post assembly and said flag means fit entirely within said base member and said base member fits entirely within said central section when said spar buoy is collapsed to said storage configuration.

* * * * *